US009408504B1

(12) United States Patent
Cordeau

(10) Patent No.: US 9,408,504 B1
(45) Date of Patent: Aug. 9, 2016

(54) TOILET PAPER DISPENSER WITH A SLIDABLE SHELF

(71) Applicant: Med Cordeau, Mississauga (CA)

(72) Inventor: Med Cordeau, Mississauga (CA)

( * ) Notice: Subject to any disclaimer, the term of this patent is extended or adjusted under 35 U.S.C. 154(b) by 0 days.

(21) Appl. No.: 14/921,056

(22) Filed: Oct. 23, 2015

(51) Int. Cl.

| | |
|---|---|
| ***A47F 3/02*** | (2006.01) |
| ***A47K 10/22*** | (2006.01) |
| ***A47K 10/38*** | (2006.01) |
| *A47K 10/32* | (2006.01) |

(52) U.S. Cl.
CPC ..... *A47K 10/22* (2013.01); *A47K 10/38* (2013.01); *A47K 2010/3233* (2013.01)

(58) Field of Classification Search
CPC ..... A47K 10/22; A47K 10/38
USPC ..... 312/34.22, 45
See application file for complete search history.

(56) References Cited

U.S. PATENT DOCUMENTS

| | | | | | |
|---|---|---|---|---|---|
| 2,407,971 | A * | 9/1946 | Black | A47F 1/08 | 242/560.3 |
| 2,459,252 | A * | 1/1949 | Strahan | A47K 10/3836 | 242/560.3 |
| 2,605,975 | A * | 8/1952 | Page | A47K 10/22 | 242/560.3 |
| 3,271,090 | A * | 9/1966 | Smithers | A47K 10/38 | 242/560 |
| 4,098,469 | A * | 7/1978 | McCarthy | A47K 10/38 | 242/560.3 |
| 4,124,259 | A * | 11/1978 | Harris | A47K 10/40 | 242/560 |
| 5,570,938 | A * | 11/1996 | Butler | A47K 10/22 | 211/59.1 |
| 6,161,794 | A * | 12/2000 | Cravatt | A47K 10/38 | 242/560 |
| 6,302,350 | B1 * | 10/2001 | Burrell | A47K 10/38 | 242/560 |
| 6,315,237 | B1 * | 11/2001 | Hoerner | A47K 10/38 | 242/560 |
| 6,957,791 | B2 * | 10/2005 | Ellis | A47K 10/22 | 242/560 |

* cited by examiner

*Primary Examiner* — Hanh V Tran
(74) *Attorney, Agent, or Firm* — Crossley and Stevenson Intellectual Property Law

(57) ABSTRACT

A toilet paper dispenser with a slidable shelf including a cabinet having a right side, a left side, a back side, a top side, a bottom side, a continuous front surface, an interior compartment, and a hinged front door. Each of a right slot of a pair of slots and a left slot of a pair of slots is horizontally disposed within an interior surface of the right side of the cabinet and the left side of the cabinet, respectively. A right edge of a shelf and a left edge of a shelf are removably and slidably engageable within the right slot and the left slot, respectively. Each of a pair of apertures is disposed within the interior surface of each of the right side of the cabinet and the left side of the cabinet. A toilet paper roller is removably suspendable between the pair of apertures.

5 Claims, 4 Drawing Sheets

TOILET PAPER DISPENSER WITH A SLIDABLE SHELF

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of toilet paper dispensers are known in the prior art. However, what has been needed is a toilet paper dispenser with a slidable shelf including a cabinet having a right side, a left side, a back side, a top side, a bottom side, a continuous front surface, an interior compartment, and a hinged front door. What has been further needed is for each of a right slot of a pair of slots and a left slot of a pair of slots to be horizontally disposed within an interior surface of the right side of the cabinet and the left side of the cabinet, respectively. A right edge of a shelf and a left edge of a shelf are removably and slidably engageable within the right slot and the left slot, respectively. Lastly, what has been needed is for each of a pair of apertures to be disposed within the interior surface of each of the right side of the cabinet and the left side of the cabinet. A toilet paper roller is removably suspendable between the pair of apertures, and a plurality of toilet paper rolls is vertically stackable within the interior compartment of the cabinet atop the shelf. Unlike other toilet paper dispensers, the toilet paper dispenser with a slidable shelf can be flush mounted within the bathroom wall to maximize storage space within a bathroom. Additionally, the toilet paper dispenser with a slidable shelf enhances hygiene, since the plurality of toilet paper rolls are stored within an enclosed structure that protects them from dust, hair, and other pollutants typically found within the bathroom.

FIELD OF THE INVENTION

The present invention relates to toilet paper dispensers, and more particularly, to a toilet paper dispenser with a slidable shelf.

SUMMARY OF THE INVENTION

The general purpose of the present toilet paper dispenser with a slidable shelf, described subsequently in greater detail, is to provide a toilet paper dispenser which has many novel features that result in a flush mounted storage cabinet which is not anticipated, rendered obvious, suggested, or even implied by prior art, either alone or in combination thereof.

To accomplish this, the present toilet paper dispenser with a slidable shelf includes a cabinet having a right side, a left side, a back side, a top side, a bottom side, a continuous front surface, an interior compartment and a hinged front door having an outer surface, an inner surface, a right surface, a left surface, a bottom surface, and a handle disposed on the outer surface proximal the left surface. A width of the cabinet optionally substantially conforms to a distance between a pair of adjacent wall studs in a bathroom wall, with the cabinet flush mountable between the pair of adjacent wall studs such that the front door of the cabinet is flush with the bathroom wall. Each of the right side and the left side has an exterior surface and an interior surface. The front door is vertically extended from the top side of the cabinet to approximately three-quarters of a length of the cabinet. A magnetic locking device has a first magnetic lock and a second magnetic lock. The first magnetic lock is disposed on the inner surface of the front door of the cabinet proximal the left surface, and the second magnetic lock is medially disposed on the cabinet front surface. The first magnetic lock is removably attachable to the second magnetic lock when the front door of the cabinet is in a closed position.

The toilet paper dispenser with a slidable shelf further includes a pair of slots. The pair of slots includes a right slot and a left slot. The right slot is continuously and horizontally disposed within the interior surface of the right side of the cabinet adjacent to and underneath the bottom surface of the front door of the cabinet from the front surface of the cabinet to the back side of the cabinet. The left slot is continuously disposed within the interior surface of the left side of the cabinet adjacent to and underneath the bottom surface of the front door of the cabinet from the front surface of the cabinet to the back side of the cabinet. A width of each of the right slot and the left slot is approximately one-half of a thickness of each of the right side of the cabinet and the left side of the cabinet. A shelf has a right edge, a left edge, a front edge, and an upwardly curved lip continuously disposed along the front edge. The curved lip of the shelf prevents a plurality of toilet paper rolls from rolling out of the cabinet while a user is vertically stacking them within the cabinet. The right edge and the left edge are removably and slidably engageable within the right slot and the left slot, respectively, such that the shelf is removably disposed within the interior compartment of the cabinet. A length of each of the right edge of the shelf and the left edge of the shelf substantially conforms to a width of each of the right side of the cabinet and the left side of the cabinet. A length of the shelf from the right edge of the shelf to the left edge of the shelf substantially conforms to a width of the interior compartment of the cabinet.

A right aperture of a pair of circular apertures is disposed within the interior surface of the right side of the cabinet underneath the right slot, and a left aperture of the pair of circular apertures is disposed within the interior surface of the left side of the cabinet underneath the left slot. The right aperture is collinearly disposed with the left aperture. A substantially cylindrical toilet paper roller is removably suspendable between the pair of apertures. A plurality of toilet paper rolls is vertically stackable within the interior compartment of the cabinet atop the shelf. The shelf is configured to be slidably removed from within the interior compartment of the cabinet in order to allow one of the plurality of toilet paper rolls to drop below the shelf so that the user may slide the one of the plurality of toilet paper rolls onto the toilet paper roller for use.

Thus has been broadly outlined the more important features of the present toilet paper dispenser with a slidable shelf so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
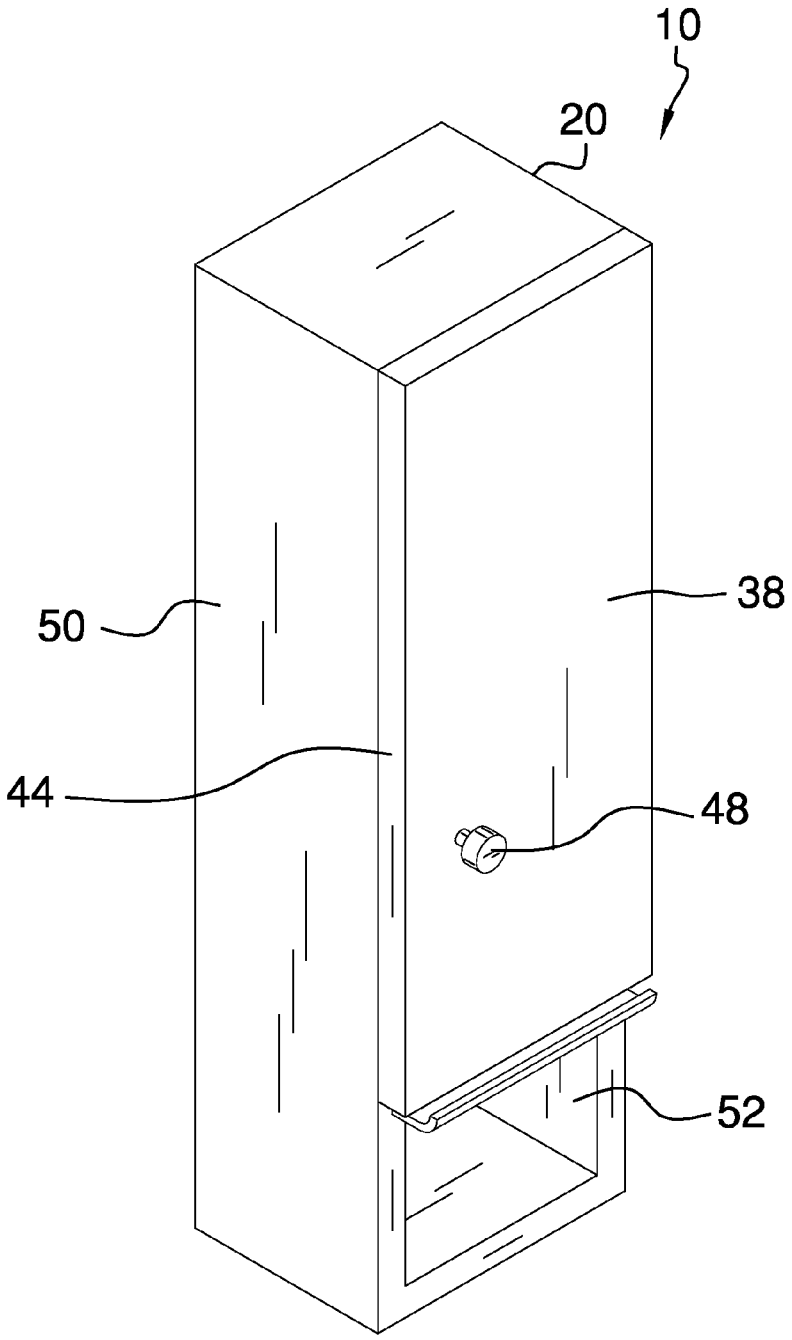
FIG. 1 is a front isometric view.
Figure 2:
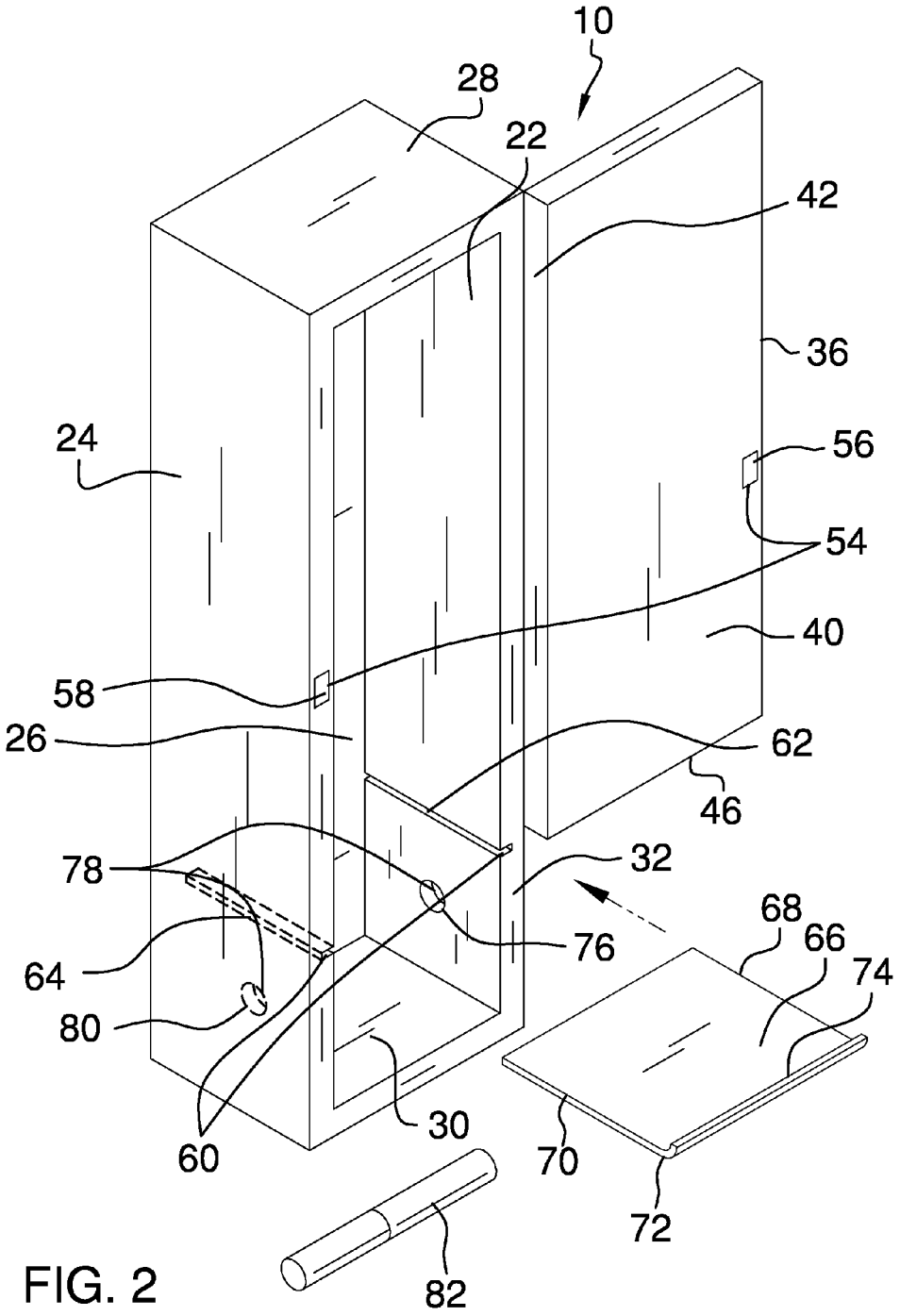
FIG. 2 is an exploded view.
Figure 3:
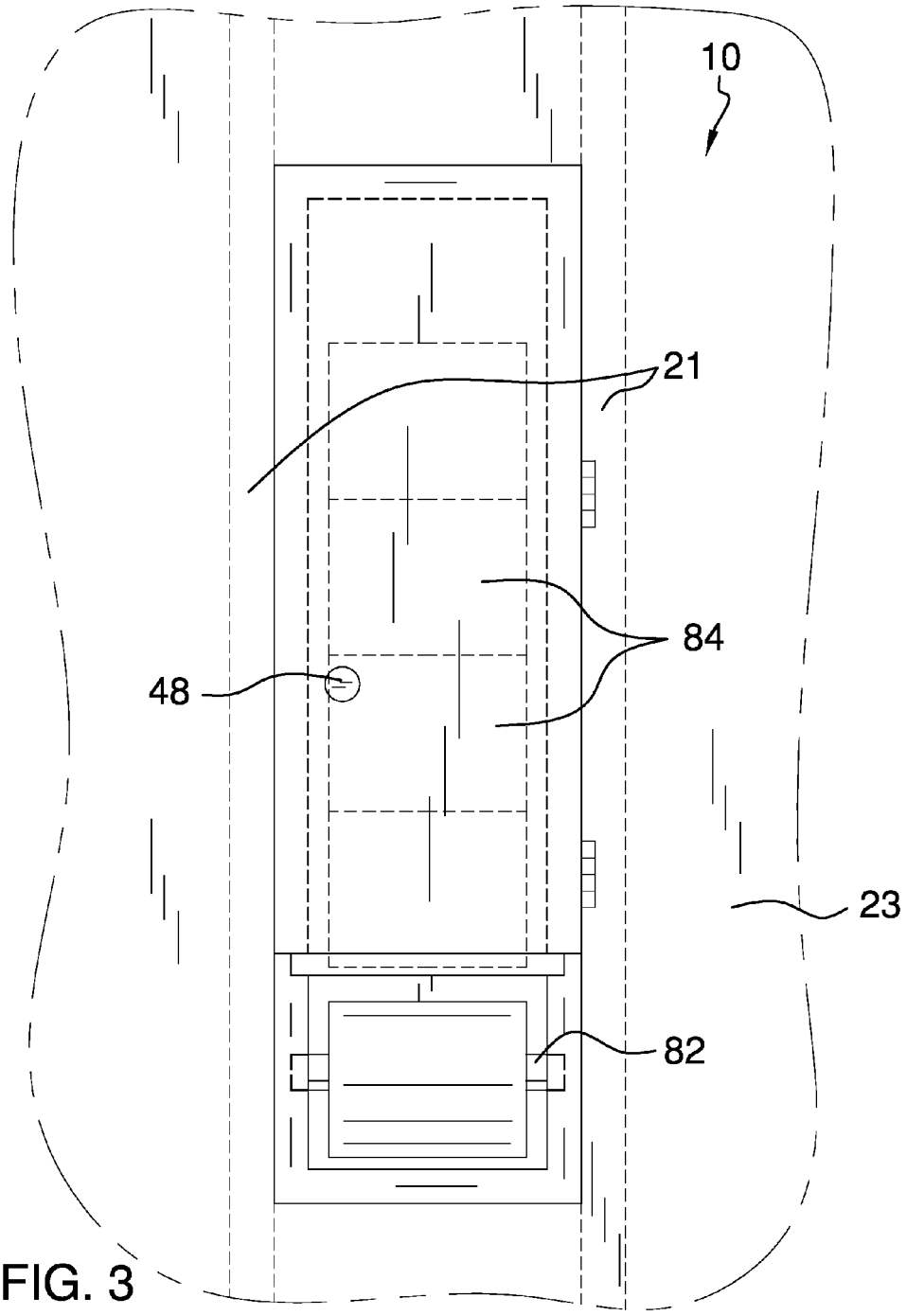
FIG. 3 is a front elevation view.
Figure 4:
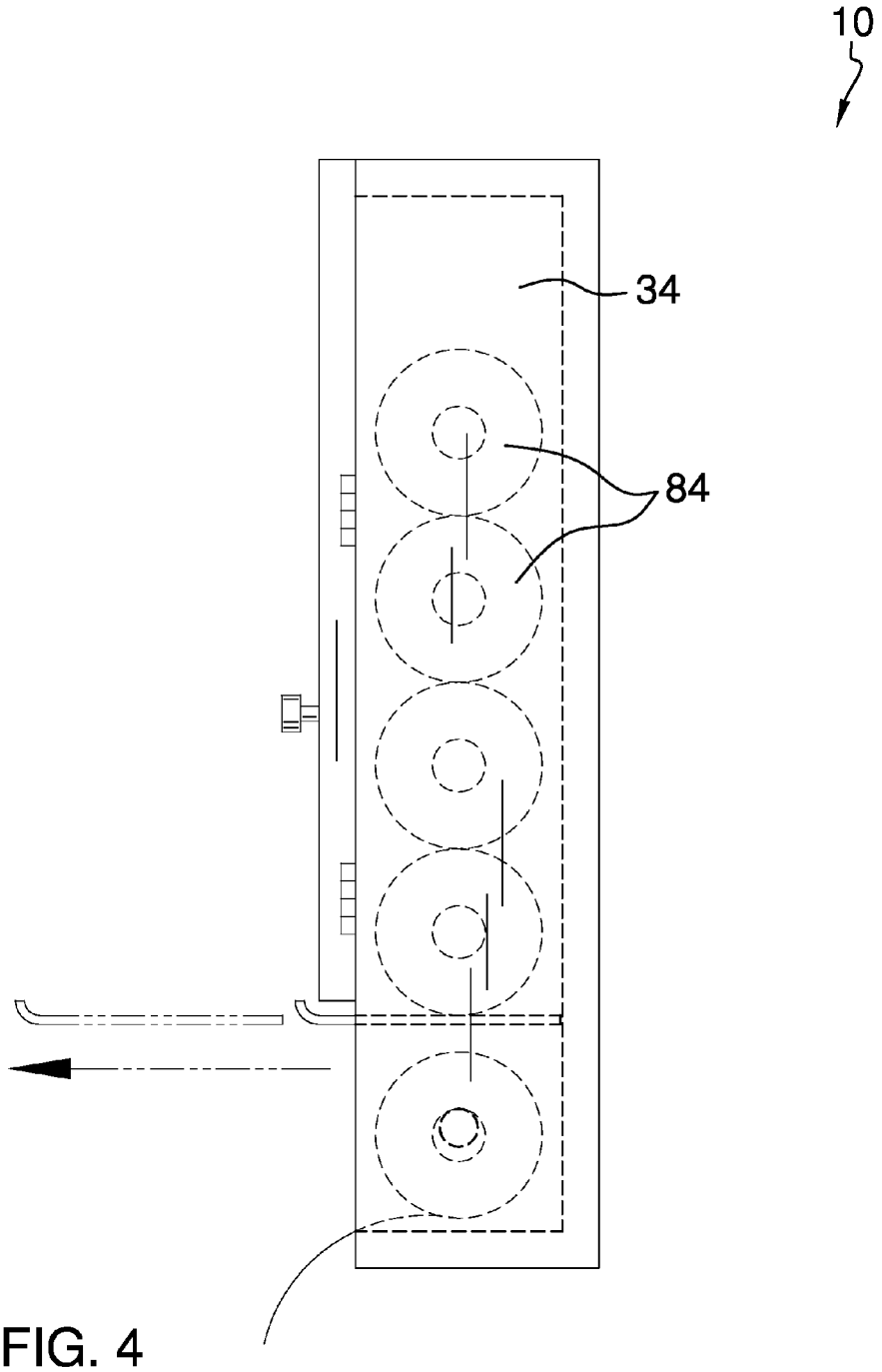
FIG. 4 is a side elevation view.

With reference now to the drawings, and in particular FIGS. 1 through 4 thereof, an example of the instant toilet paper dispenser with a slidable shelf employing the principles and concepts of the present toilet paper dispenser with a slidable shelf and generally designated by the reference number 10 will be described.

Referring to FIGS. 1 through 4 the present toilet paper dispenser with a slidable shelf 10 is illustrated. The toilet paper dispenser with a slidable shelf 10 includes a cabinet 20 having a rectangular right side 22, a rectangular left side 24, a back side 26, a top side 28, a bottom side 30, a continuous front surface 32, an interior compartment 34 and a hinged front door 36 having an outer surface 38, an inner surface 40, a right surface 42, a left surface 44, a bottom surface 46, and a handle 48 disposed on the outer surface 38 proximal the left surface 44. A width of the cabinet 20 optionally substantially conforms to a distance between a pair of adjacent wall studs 21 in a bathroom wall 23, with the cabinet 20 flush mountable between the pair of adjacent wall studs 21 such that the front door 36 of the cabinet 20 is flush with a bathroom wall. Each of the right side 22 and the left side 24 has an exterior surface 50 and an interior surface 52. The front door 36 is vertically extended from the top side 28 of the cabinet 20 to approximately three-quarters of a length of the cabinet 20. A magnetic locking device 54 has a first magnetic lock 56 and a second magnetic lock 58. The first magnetic lock 56 is disposed on the inner surface 40 of the front door 36 of the cabinet 20 proximal the left surface 44, and the second magnetic lock 58 is medially disposed on the front surface 32 of the cabinet 20. The first magnetic lock 56 is removably attachable to the second magnetic lock 58 when the front door 36 of the cabinet 20 is in a closed position.

The toilet paper dispenser with a slidable shelf 10 further includes a pair of slots 60. The pair of slots 60 includes a right slot 62 and a left slot 64. The right slot 62 is continuously and horizontally disposed within the interior surface 52 of the right side 22 of the cabinet 20 adjacent to and underneath the bottom surface 46 of the front door 36 of the cabinet 20 from the front surface 32 of the cabinet 20 to the back side 26 of the cabinet 20. The left slot 64 is continuously disposed within the interior surface 52 of the left side 24 of the cabinet 20 adjacent to and underneath the bottom surface 46 of the front door 36 of the cabinet 20 from the front surface 32 of the cabinet 20 to the back side 26 of the cabinet 20. A width of each of the right slot 62 and the left slot 64 is approximately one-half of a thickness of each of the right side 22 of the cabinet 20 and the left side 24 of the cabinet 20. A shelf 66 has a right edge 68, a left edge 70, a front edge 72, and an upwardly curved lip 74 continuously disposed along the front edge 72. The right edge 68 and the left edge 70 are removably and slidably engageable within the right slot 62 and the left slot 64, respectively, such that the shelf 66 is removably disposed within the interior compartment 34 of the cabinet 20. A length of each of the right edge 68 of the shelf 66 and the left edge 70 of the shelf 66 substantially conforms to a width of each of the right side 22 of the cabinet 20 and the left side 24 of the cabinet 20. A length of the shelf 66 from the right edge 68 of the shelf 66 to the left edge 70 of the shelf 66 substantially conforms to a width of the interior compartment 34 of the cabinet 20.

A right aperture 76 of a pair of circular apertures 78 is disposed within the interior surface 52 of the right side 22 of the cabinet 20 underneath the right slot 62, and a left aperture 80 of the pair of circular apertures 78 is disposed within the interior surface 52 of the left side 24 of the cabinet 20 underneath the left slot 64. The right aperture 76 is collinearly disposed with the left aperture 78. A substantially cylindrical toilet paper roller 82 is removably suspendable between the pair of apertures 78. A plurality of toilet paper rolls 84 is vertically stackable within the interior compartment 34 of the cabinet 20 atop the shelf 66.

What is claimed is:

1. A toilet paper dispenser with a slidable shelf comprising:

a cabinet having a rectangular right side, a rectangular left side, a back side, a top side, a bottom side connected to the right side and the left side, a continuous front surface, an interior compartment, and a hinged front door having an outer surface, an inner surface, a right surface, a left surface, a bottom surface, and a handle disposed on the outer surface proximal the left surface, wherein each of the right side and the left side has an exterior surface and an interior surface, wherein the front door is vertically extended from the cabinet top side to approximately three-quarters of a length of the cabinet;

a magnetic locking device having a first magnetic lock and a second magnetic lock, wherein the first magnetic lock is disposed on the inner surface of the cabinet front door proximal the left surface, and the second magnetic lock is medially disposed on the cabinet front surface, wherein the first magnetic lock is removably attachable to the second magnetic lock when the cabinet front door is in a closed position;

a pair of slots comprising a right slot and a left slot, wherein the right slot is continuously and horizontally disposed within the interior surface of the cabinet right side adjacent to and underneath the bottom surface of the cabinet front door from the cabinet front surface to the cabinet back side, and the left slot is continuously disposed within the interior surface of the cabinet left side adjacent to and underneath the bottom surface of the cabinet front door from the cabinet front surface to the cabinet back side, wherein a width of each of the right slot and the left slot is approximately one-half of a thickness of each of the cabinet right side and the cabinet left side;

a shelf having a right edge, a left edge, a front edge, and an upwardly curved lip continuously disposed along the front edge, wherein the right edge and the left edge are removably and slidably engageable within the right slot and the left slot, respectively, such that the shelf is removably disposed within the cabinet interior compartment;

wherein a length of each of the shelf right edge and the shelf left edge substantially conforms to a width of each of the cabinet right side and the cabinet left side;

wherein a length of the shelf from the shelf right edge to the shelf left edge substantially conforms to a width of the cabinet interior compartment; and a pair of circular apertures comprising a right aperture and a left aperture, wherein the right aperture is disposed within the interior surface of the cabinet right side underneath the right slot, and the left aperture is disposed within the interior surface of the cabinet left side underneath the left slot, wherein the right aperture is collinearly disposed with the left aperture, wherein a receiving space is defined by the right side, the left side, the shelf and the bottom side such that a substantially cylindrical toilet paper roller is removably suspendable therein and between the pair of apertures;

wherein a plurality of toilet paper rolls is vertically stackable within the cabinet interior compartment atop the shelf;

wherein the shelf is configured to be slidably removed from within the cabinet interior compartment in order to allow one of the plurality of toilet paper rolls to drop below the shelf so that a user may slide the one of the plurality of toilet paper rolls onto the toilet paper roller for use.

2. The toilet paper dispenser with a slidable shelf of claim 1 wherein a width of the cabinet substantially conforms to a distance between a pair of adjacent wall studs in a bathroom wall.

3. The toilet paper dispenser with a slidable shelf of claim 2 wherein the cabinet is flush mountable between the pair of adjacent wall studs such that the cabinet front door is flush with the bathroom wall.

4. The toilet paper dispenser with a slidable shelf of claim 1 wherein the cabinet is plastic.

5. A toilet paper dispenser with a slidable shelf comprising:

a cabinet having a rectangular right side, a rectangular left side, a back side, a top side, a bottom side connected to the right side and the left side, a continuous front surface, an interior compartment, and a hinged front door having an outer surface, an inner surface, a right surface, a left surface, a bottom surface, and a handle disposed on the outer surface proximal the left surface, wherein each of the right side and the left side has an exterior surface and an interior surface, wherein the front door is vertically extended from the cabinet top side to approximately three-quarters of a length of the cabinet;

wherein a width of the cabinet substantially conforms to a distance between a pair of adjacent wall studs in a bathroom wall;

wherein the cabinet is flush mountable between the pair of adjacent wall studs such that the cabinet front door is flush with the bathroom wall;

a magnetic locking device having a first magnetic lock and a second magnetic lock, wherein the first magnetic lock is disposed on the inner surface of the cabinet front door proximal the left surface, and the second magnetic lock is medially disposed on the cabinet front surface, wherein the first magnetic lock is removably attachable to the second magnetic lock when the cabinet front door is in a closed position;

a pair of slots comprising a right slot and a left slot, wherein the right slot is continuously and horizontally disposed within the interior surface of the cabinet right side adjacent to and underneath the bottom surface of the cabinet front door from the cabinet front surface to the cabinet back side, and the left slot is continuously disposed within the interior surface of the cabinet left side adjacent to and underneath the bottom surface of the cabinet front door from the cabinet front surface to the cabinet back side, wherein a width of each of the right slot and the left slot is approximately one-half of a thickness of each of the cabinet right side and the cabinet left side;

a shelf having a right edge, a left edge, a front edge, and an upwardly curved lip continuously disposed along the front edge, wherein the right edge and the left edge are removably and slidably engageable within the right slot and the left slot, respectively, such that the shelf is removably disposed within the cabinet interior compartment;

wherein a length of each of the shelf right edge and the shelf left edge substantially conforms to a width of each of the cabinet right side and the cabinet left side;

wherein a length of the shelf from the shelf right edge to the shelf left edge substantially conforms to a width of the cabinet interior compartment; and a pair of circular apertures comprising a right aperture and a left aperture, wherein the right aperture is disposed within the interior surface of the cabinet right side underneath the right slot, and the left aperture is disposed within the interior surface of the cabinet left side underneath the left slot, wherein the right aperture is collinearly disposed with the left aperture, wherein a receiving space is defined by the right side, the left side, the shelf and the bottom side such that a substantially cylindrical toilet paper roller is removably suspendable therein and between the pair of apertures;

wherein a plurality of toilet paper rolls is vertically stackable within the cabinet interior compartment atop the shelf;

wherein the shelf is configured to be slidably removed from within the cabinet interior compartment in order to allow one of the plurality of toilet paper rolls to drop below the shelf so that a user may slide the one of the plurality of toilet paper rolls onto the toilet paper roller for use.

* * * * *